US006737114B2

(12) United States Patent
Dawson, Jr. et al.

(10) Patent No.: US 6,737,114 B2
(45) Date of Patent: May 18, 2004

(54) NONWOVEN FABRIC HAVING THREE-DIMENSIONAL PRINTED SURFACE AND METHOD FOR PRODUCING THE SAME

(75) Inventors: Durwin Glenn Dawson, Jr., Greer, SC (US); Sarah Bambridge Winter, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/127,105

(22) Filed: Apr. 22, 2002

(65) Prior Publication Data

US 2003/0198746 A1 Oct. 23, 2003

(51) Int. Cl.[7] ..... B05D 1/32

(52) U.S. Cl. ..... 427/282; 427/288; 427/373; 427/389.9

(58) Field of Search ..... 427/176, 256, 427/282, 288, 373, 381, 389.9, 394; 101/129; 428/141, 158–161, 190, 260, 262, 265

(56) References Cited

U.S. PATENT DOCUMENTS

| | | | | | |
|---|---|---|---|---|---|
| 4,365,551 | A | | 12/1982 | Horton | 101/124 |
| 4,837,902 | A | | 6/1989 | Dischler | 26/1 |
| 4,854,230 | A | | 8/1989 | Niki et al. | 101/123 |
| 4,918,795 | A | | 4/1990 | Dischler | 26/1 |
| 5,133,088 | A | | 7/1992 | Dunlap | 2/241 |
| 5,150,660 | A | * | 9/1992 | Kuczynski | |
| 5,168,805 | A | | 12/1992 | Kasanami et al. | 101/128.21 |
| 5,493,969 | A | | 2/1996 | Takahashi et al. | 101/126 |
| 5,822,835 | A | | 10/1998 | Dischler | 28/167 |
| 5,899,785 | A | * | 5/1999 | Groten et al. | |
| 5,970,583 | A | | 10/1999 | Groten et al. | 19/296 |
| 6,092,464 | A | * | 7/2000 | Meola et al. | |
| 6,237,490 | B1 | | 5/2001 | Takahashi et al. | 101/129 |
| 2002/0007540 | A1 | | 1/2002 | Black et al. | 28/105 |

* cited by examiner

*Primary Examiner*—Fred J. Parker
(74) *Attorney, Agent, or Firm*—Terry T. Moyer; Brenda D. Wentz

(57) ABSTRACT

The present invention relates to a nonwoven fabric having a three-dimensional printed surface which is achieved by screen printing the fabric with a puff pigment to create an inexpensive, textured fabric. The fabric is preferably printed with a puff pigment of constrasting color, when compared with the color of the base fabric, so that an aesthetically pleasing two-tone fabric is produced. The fabric is primarily composed of continuous multi-component fibers that are at least partially split along their length. The fabric may be manufactured into such end-use products as automotive interior fabric, apparel, drapery, cleaning cloths, upholstery, and office panels. Also encompassed within this invention is a method for producing a nonwoven fabric having a three-dimensional printed surface.

18 Claims, 4 Drawing Sheets

NONWOVEN FABRIC HAVING THREE-DIMENSIONAL PRINTED SURFACE AND METHOD FOR PRODUCING THE SAME

BACKGROUND OF THE INVENTION

The present invention relates to a nonwoven fabric having a three-dimensional printed surface which is achieved by screen printing the fabric with a puff pigment to create an inexpensive, textured fabric. The fabric is preferably printed with a puff pigment of contrasting color, when compared with the color of the base fabric, so that an aesthetically pleasing two-tone fabric is produced. The fabric is primarily comprised of continuous multi-component fibers that are at least partially split along their length, and the fabric may be manufactured into such end-use products as automotive interior fabric, apparel, drapery, cleaning cloths, upholstery, and office panels. Also encompassed within this invention is a method for producing a nonwoven fabric having a three-dimensional printed surface.

Nonwoven textile articles have historically possessed many attributes that led to their use for many items of commerce, such, as air filters, furniture lining, and vehicle floorcovering, side panel and molded trunk linings. Among these attributes are lightweightness of the fabric, low cost and simplicity of the manufacturing process, and various other advantages. More recently, technological advances in the field of nonwovens, in areas such as abrasion resistance, fabric drape, fabric softness, and wash durability, have created new markets for nonwoven materials. For example, U.S. Pat. Nos. 5,899,785 and 5,970,583, both assigned to Freudenberg, describe a nonwoven lap of very fine continuous filament and the process for making such nonwoven lap using traditional nonwoven manufacturing techniques. The raw material for this nonwoven fabric is a spun-bonded composite, or multi-component, fiber that is splittable along its length by mechanical or chemical action. As an example, after a nonwoven lap is formed, it may be subjected to high-pressure water jets which cause the composite fibers to partially separate along their length and become entangled with one another thereby imparting strength and microfiber-like softness to the final product. One such product manufactured and made available by Freudenberg according to these processes is known as Evolon®, and it is available in point bonded or non-point bonded (i.e., "standard") variations. These manufacturing techniques allow for the efficient and inexpensive production of nonwoven fabrics having characteristics, such as strength, softness, and drapeability, at least equal to those of woven or knitted fabrics, which have end uses in products such as apparel, cleaning cloths, and artificial leather.

With the emergence of nonwoven fabrics into these new markets and increased consumer interest in such products, there has been a desire to create these nonwoven fabrics with decorative and aesthetically pleasing characteristics in combination with their strength and drapeability features. Combining screen printing with a puff pigment to print a nonwoven fabric achieves such desirable characteristics; this method also imparts various functional characteristics as well. For example, some printed patterns on a nonwoven fabric may optimize the fabric's slip resistance when used, for example, as a trunk lining fabric to reduce or eliminate the movement of items placed in the trunk during travel. Furthermore, some patterns may preferably increase the printed fabric's sound absorption properties because the raised images generally increase the fabric's surface area.

This feature results in a fabric that is ideal for use as automotive interior fabric, such as headliner fabric, or as office furniture upholstery or office panels.

Screen printing techniques have been available for many years as a way of selectively producing a pattern on a fabric by forcing a colored paste through holes in a screen. For example, U.S. Pat. No. 4,365,551 to Horton; U.S. Pat. No. 4,854,230 to Niki et al.; U.S. Pat. No. 5,168,805 to Kasanami et al.; U.S. Pat. No. 5,493,969 to Takahashi et al., and U.S. Pat. No. 6,237,490 to Takahashi et al. each describe various screen printing methods and apparatus, and are herein incorporated by reference. Additionally, puff pigments may be used to create raised, three-dimensional images on a textile fabric by incorporating a puffing agent into the colored pigment selected for printing. Screen printing methods may be used to place the puff pigment on the fabric. When the puff pigment is subsequently dried and cured, the puffing agent in the pigment expands, thereby creating raised, three-dimensional images on the surface of the fabric. Since the nonwoven fabric may be dyed or undyed before printing, the puff pigment color may be chosen so as to optimize the color contrast between the fabric and the printed, raised image or pattern. Furthermore, the puff pigment may contain a binding agent, which may enhance the adherence of the raised, three-dimensional image to the fabric. Creating these textured, decorative patterns on a nonwoven textile fabric has enabled the introduction of this fabric into new markets where it may be utilized in such end-use products as automotive headliner fabric, apparel, drapery, cleaning cloths, upholstery, and office panels.

SUMMARY OF THE INVENTION

In light of the foregoing discussion, it is one object of the current invention to achieve a nonwoven fabric having a three-dimensional printed surface. The three-dimensional printed surface is most preferably achieved by screen printing the fabric with a puff pigment, wherein the puff pigment most preferably includes a puffing agent and a binding agent. The nonwoven fabric may be printed with various patterns, which are selected to preferably optimize the aesthetic appearance of the fabric and/or to optimize the performance characteristics of the printed fabric. The resulting textured fabric may perform well in end-use applications such as cleaning cloths wherein the textured surface may assist in the removal of dirt from soiled surfaces; alternatively, the fabric may be well suited for use as automotive interior fabric such as, for example, headliner fabric.

A second object of the current invention is to achieve a nonwoven fabric having a three-dimensional printed surface, wherein the printed surface comprises colored pigment that is decorative and aesthetically pleasing. The combination of texture, depth, and color enhances the appearance and feel of the fabric such that it may be ideal for use in products such as, for example, automotive interior fabric, apparel, drapery, cleaning cloths, upholstery, and office panels.

A further object of the current invention is to achieve a composite material, wherein the composite material is comprised of at least one layer of nonwoven fabric having a three-dimensional printed surface. Other layers in the composite material may be comprised of additional nonwoven fabrics, woven or knitted fabrics, various types of foam materials such as polyurethane, polystyrene, polyether, and polyester foams, films, adhesives, and combinations thereof. The composite material may be used, for example, in automobile interiors, for items such as door panels, arm rests, and headliners, as well as in various other applications.

It is also an object of the current invention to achieve a method for producing a nonwoven fabric having a three-dimensional printed surface. The method generally comprises the steps of providing a nonwoven textile fabric, screen printing the fabric with a puff pigment, and drying and curing the fabric. The fabric may then be manufactured into its final product for consumer use without having to sew or further finish its cut edges, thereby saving time and expense.

Other objects, advantages, and features of the current invention will occur to those skilled in the art. Thus, while the invention will be described and disclosed in connection with certain preferred embodiments and procedures, such embodiments and procedures are not intended to limit the scope of the current invention. Rather, it is intended that all such alternative embodiments, procedures, and modifications are included within the scope and spirit of the disclosed invention and limited only by the appended claims and their equivalents.

DETAILED DESCRIPTION OF THE INVENTION

Figure 1:
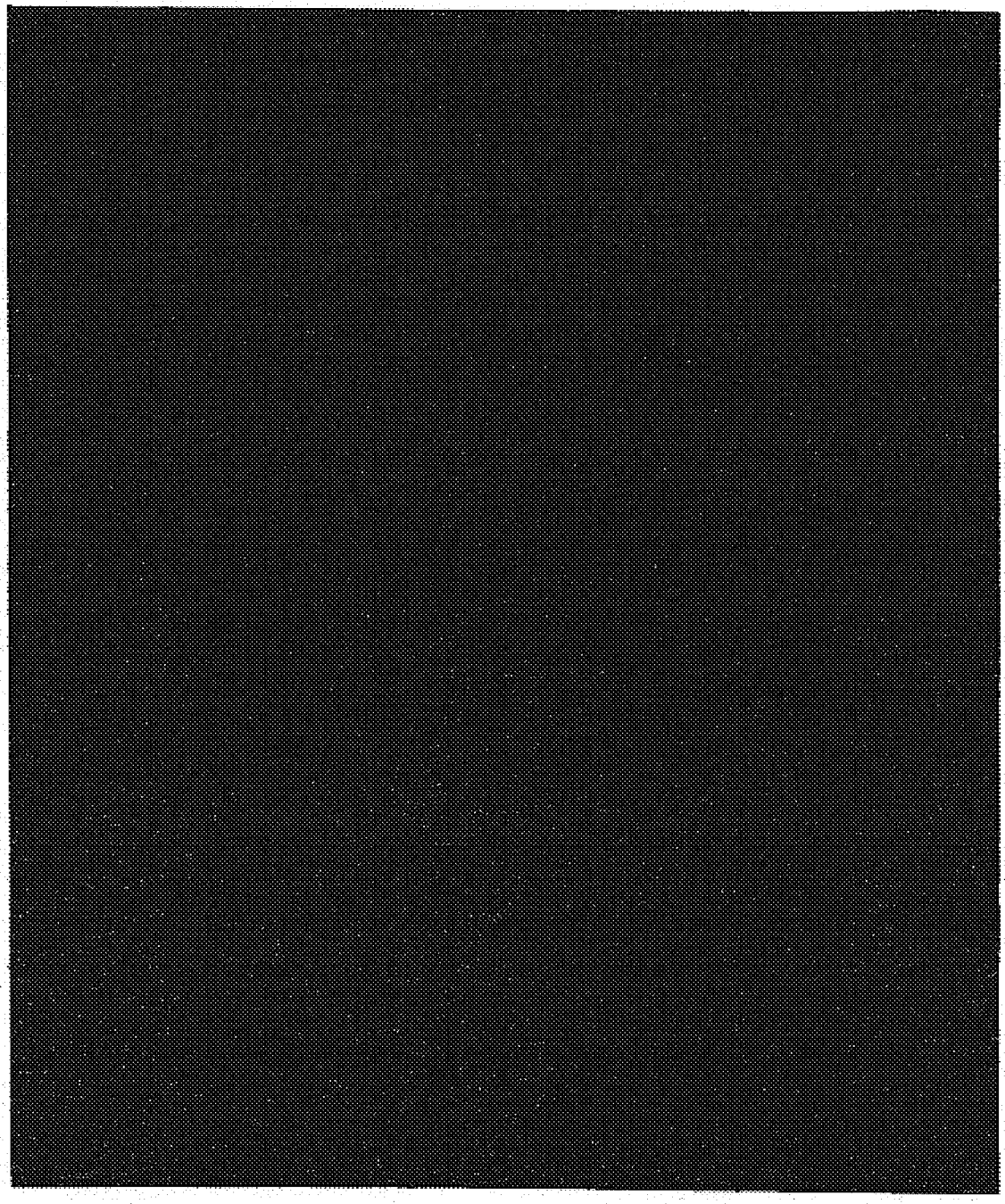
FIG. 1 is photocopy of 100 g/m$^2$ solution dyed Evolon® nonwoven fabric after screen printing with a puff pigment. This pattern created small dots arranged in substantially straight lines that are approximately at a 45 degree angle to the horizontal and that intersect each other, thereby creating an image of small squares which have been rotated approximately 45 degrees. This puff pigment pattern imparts approximately 7.20% print coverage on the surface of the nonwoven fabric.

A nonwoven fabric having a three-dimensional printed surface is provided which possess certain decorative and functional characteristics. U.S. Pat. Nos. 5,899,785 and 5,970,583, both incorporated herein by reference, describe the composition and process for manufacturing a nonwoven fabric that is preferably modified by the puff pigment printing of the current invention. Typically, the nonwoven fabric is comprised of spun-bonded continuous multi-component filament fiber that has been split, either partially or wholly, into its individual component fibers by exposure to mechanical or chemical means, such as high-pressure fluid jets. The fibers may be of any fiber size, but they are preferably characterized by having a fiber size of less than 5 denier. Further, the fibers, when extruded as multi-component fibers, are preferably characterized by having individual filament sizes of less than 1 denier.

The fibers may be comprised of various fiber types including polyester, such as, for example, polyethylene terephthalate, polytriphenylene terephthalate, and polybutylene terephthalate; polyamide, such as, for example, nylon 6 and nylon 6,6; polyolefins, such as, for example, polypropylene, polyethylene, and the like; polyaramides, such as, for example, Kevlar®; polyurethanes; polylactic acid; and any combination thereof.

The fabric composition is generally 65% polyester fiber and 35% nylon 6 or nylon 6,6 fiber. Additionally, other fiber variations and combinations described by the above-mentioned Freudenberg patents are contemplated to be within the scope of this invention.

Many techniques are known to apply dyes and pigments to a textile substrate for the purpose of patterning the surface of the substrate. Among the most common is the direct application of dyes and pigments of the desired colors to a previously dyed or undyed substrate. This technique is known as direct printing. Perhaps the most widely used direct printing technique is screen printing, in which dyes or pigments are forced through a specially prepared screen onto a substrate such as a fabric. The screen has areas in which the mesh has been blocked. These areas, which remain impervious to the dye or pigment, correspond to patterned areas on the fabric in which no dye or pigment is desired. It is this screen printing process that is most preferable for the method of printing as described herein according to the current invention, although other direct printing techniques capable of producing a three-dimensional pattern on a fabric are also contemplated to be within the scope of this invention.

Prior to the screen printing process, the nonwoven fabric may be dyed or undyed. If a dyed fabric is desired, dyeing may be accomplished any technique known to those skilled in the art, such as, for example, by solution dyeing the fiber used to make the nonwoven fabric, dyeing the formed fabric in a jet dye machine, dyeing the formed fabric using a continuous process dyeing range, or any combination thereof. Additionally, the fabric may also be subjected to various face-finishing processes prior to screen printing. For example, commonly assigned U.S. Pat. Nos. 5,822,835, 4,918,795, and 4,837,902, incorporated herein by reference, disclose a face-finishing process wherein low-pressure streams of gas are directed at high velocity to the surface of a fabric. The process ultimately softens and conditions the fabric due to vibration caused from airflow on the fabric.

Puff pigments are readily available on the open market from suppliers such as Pioneer Chemical of Greenville, S.C. They typically contain a puffing agent and, when desirable, a binding agent. When a puff pigment is applied to the surface of a substrate, such as a fabric, and the substrate is exposed to elevated temperature, the puffing agent forms a gas which causes the pigment to rise and create a three-dimensional shape on the substrate. A binding agent is often added to the puff pigment for the purpose of enhancing the pigment's adherence to the fabric. The aforementioned nonwoven fabric comprised of continuous, multi-component splittable fibers is particularly adept at holding the puff pigment in place at least partly due to its microdenier sized individual filament fibers which greatly increase the surface area of the fabric. Even with this increased surface area, it may, nonetheless, be desirable to use a puff pigment that contains a binding agent for certain end-use applications of the product such as, for example, cleaning cloths.

Figure 2:
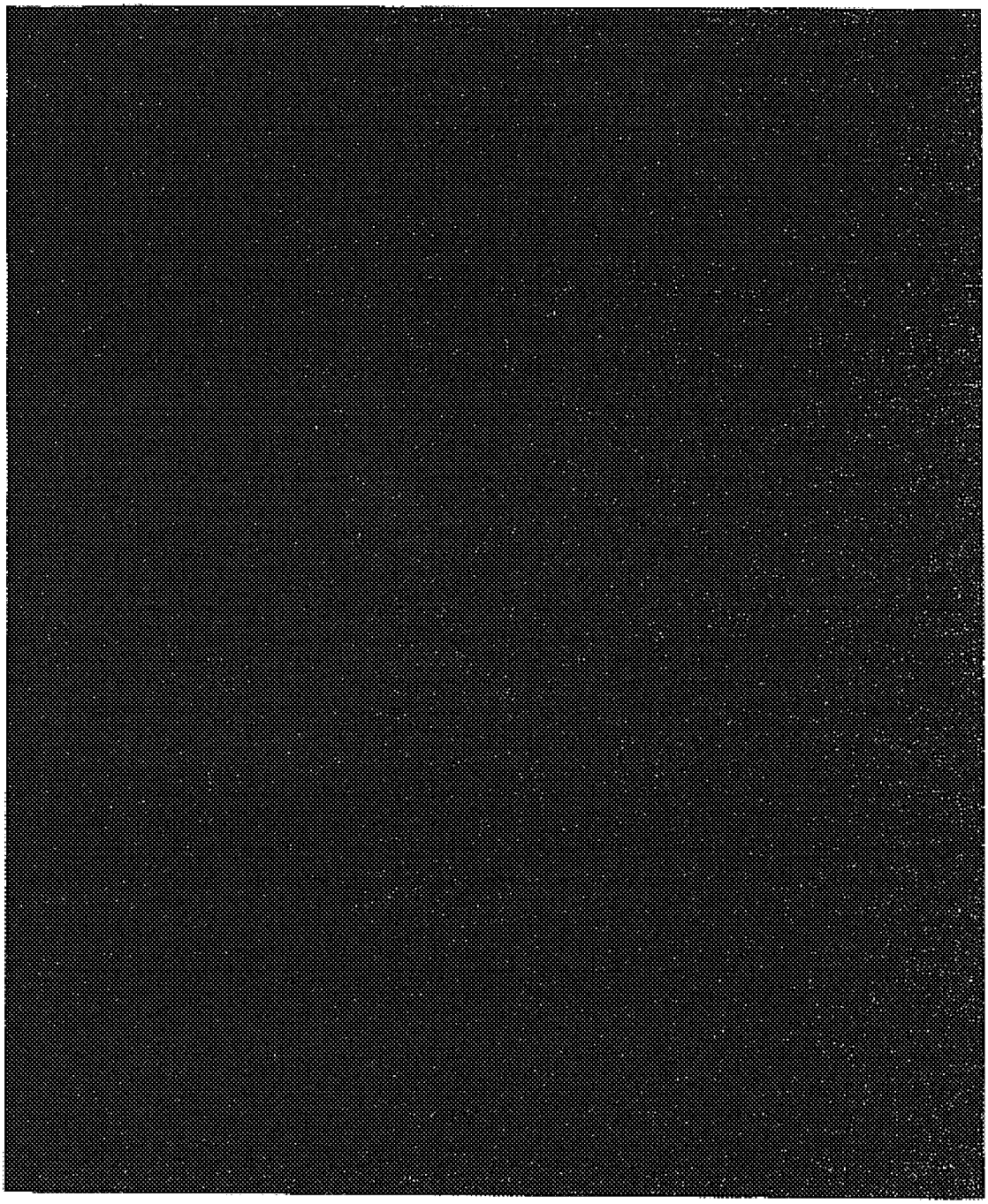
FIG. 2 is a photocopy of 100 g/m$^2$ solution dyed Evolon® nonwoven fabric after screen printing with a puff pigment to create substantially square shapes that are set approximately equal distance apart and which are arranged vertically in substantially straight lines. Within the squares are two hourglass-like shapes arranged perpendicular to each other with the vertical hourglass-like shape having less printed area than the horizontal hourglass-like shape. This puff pigment pattern imparts approximately 2.91% print coverage on the surface of the nonwoven fabric.
Figure 3:
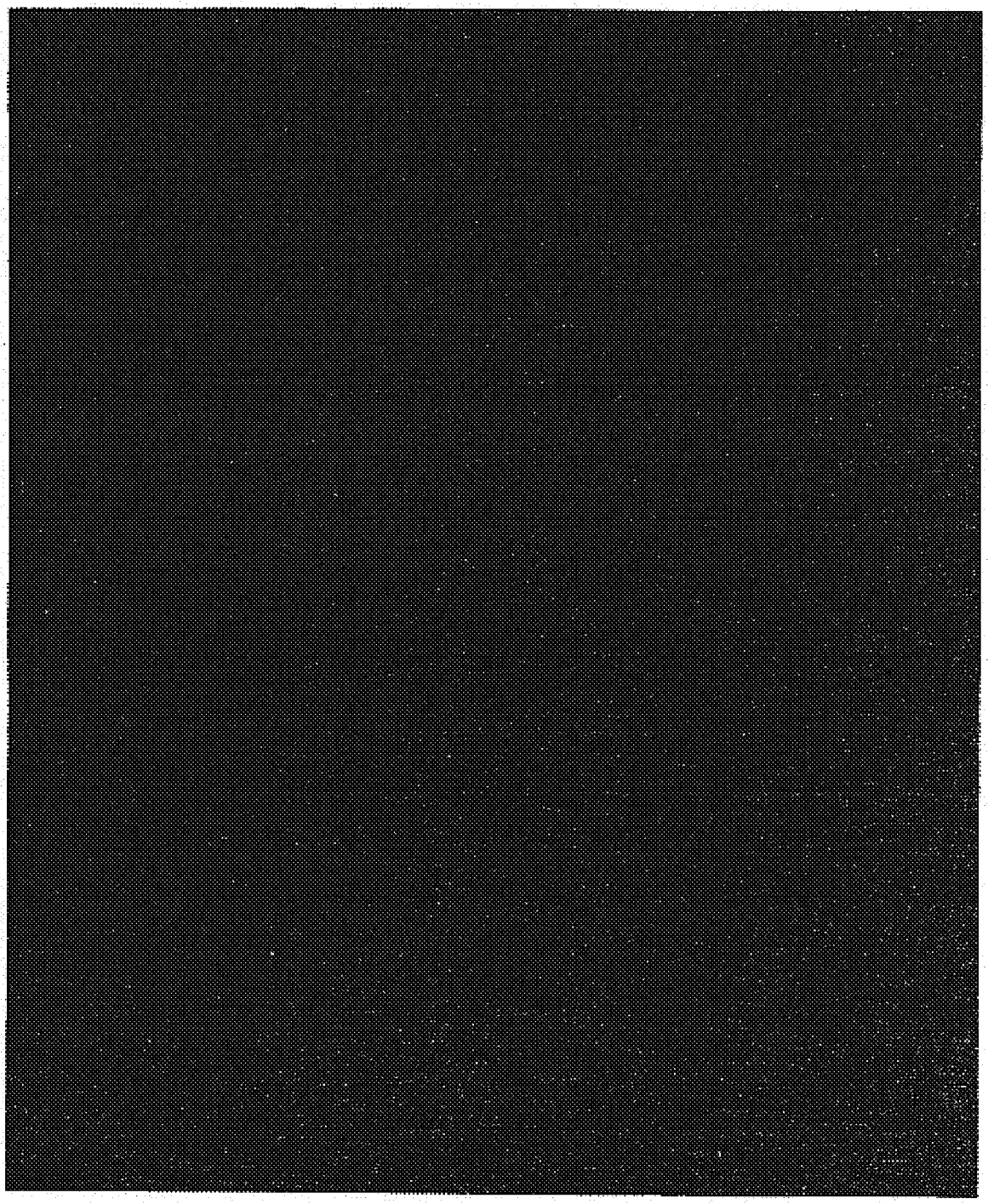
FIG. 3 is a photocopy of 100 g/m$^2$ solution dyed Evolon® nonwoven fabric after screen printing with a puff pigment to create small dots set approximately equal distance apart and in substantially straight lines, wherein the straight lines are approximately at a 45 degree angle to the horizontal. The pattern also contains substantially square shapes set equal distance apart. The square shapes are larger than the small dots also contained in this pattern, and they are spaced further apart than the small dots. The square shapes are also arranged in substantially straight lines which are approximately at a 45 degree angle to the horizontal. This puff pigment pattern imparts approximately 2.41% print coverage on the surface of the nonwoven fabric.
Figure 4:
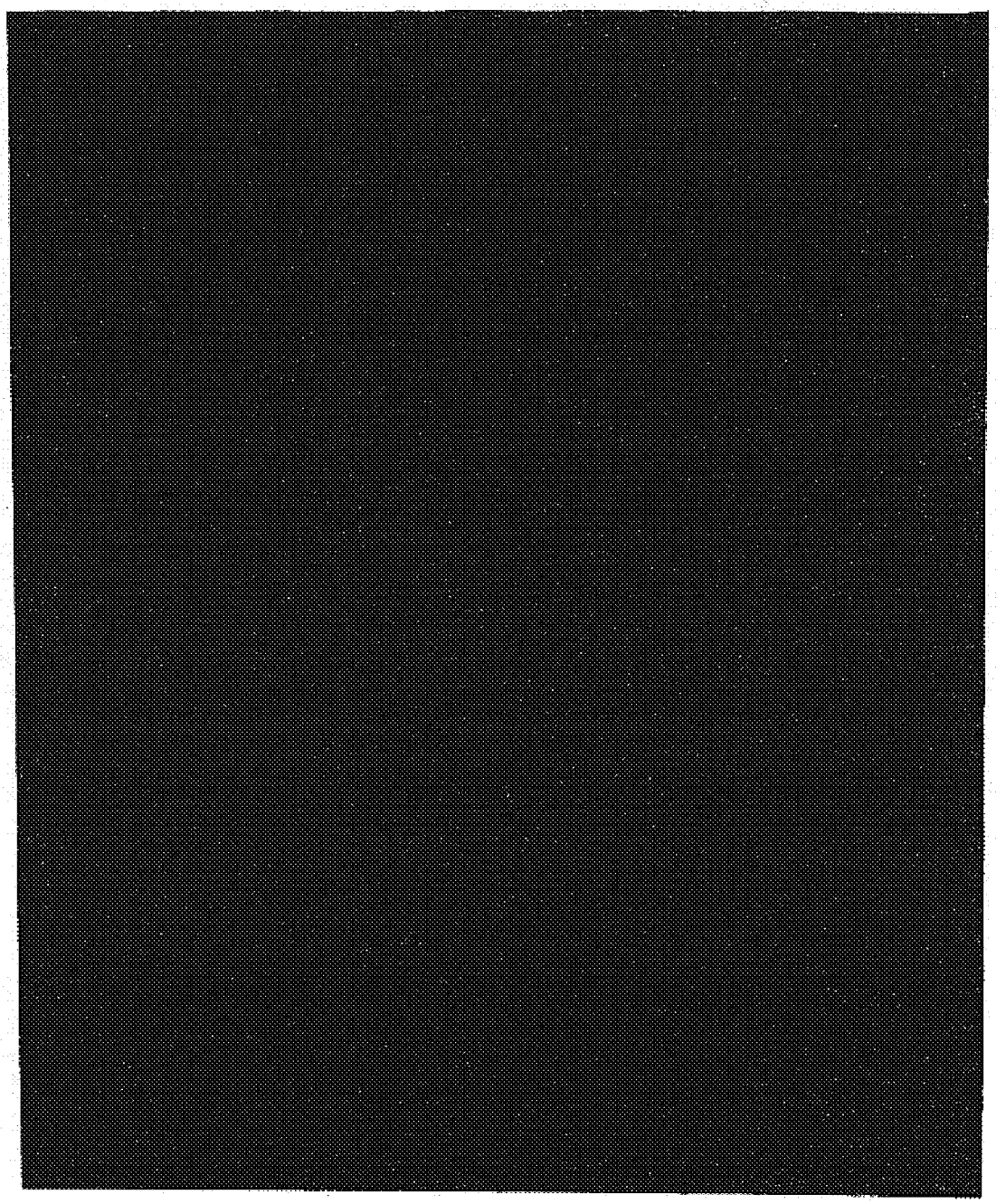
FIG. 4 is a photocopy of 100 g/m$^2$ solution dyed Evolon® nonwoven fabric after screen printing with a puff pigment to create substantially square shapes which are equal distance apart and arranged in substantially straight vertical lines. The squares are comprised of alternating printed and non-printed substantially straight lines which are set at approximately a 45 degree angle to the horizontal. This puff pigment pattern imparts approximately 1.20% print coverage on the surface of the nonwoven fabric.

In one aspect of the invention, the process of the current invention requires no special equipment; standard textile dyeing and finishing equipment can be employed. By way of example, a nonwoven fabric, either previously dyed or left undyed, is attached to a rotary screen printing machine. The desired screen is inserted on the machine, and then a selected puff pigment is added to the machine. The squeegee in the screen forces the puff pigment through the holes in the screen, thereby forming a printed pattern on the fabric below. The fabric typically moves in a continuous fashion to a drying oven where the puff pigment is dried. This drying step triggers the puffing agent to form a gas thereby causing the pigment to rise. Drying can be accomplished by any technique typically used in manufacturing operations, such as dry heat from a tenter frame, microwave energy, infrared heating, steam, superheated steam, autoclaving, etc. or any combination thereof. The fabric is subsequently exposed to a higher temperature curing oven which activates the binder in the puff pigment; the binder generally enhances the adherence between the pigment and the fabric. The amount of puff pigment required depends on the pattern chosen for the fabric, and this will typically be determined by the fabric's end-use. Some patterns provide less than 2% print coverage on the fabric as shown, for example, in FIG. 4, while others may provide 60% or more print coverage. It may be preferable that the print coverage be between about 2% and about 60% as shown, for example, in FIGS. 2 and 3, or even more preferably, perhaps between about 5% and about 30% as shown, for example, in FIG. 1. The drying and curing temperatures may vary depending on the exact chemistry of the puff pigment employed for the printing process. The puff pigments vary in viscosity and chemical composition due such options as binding agents, which may be added for optimum performance. It is also contemplated that both sides of the fabric may be printed according to the method of the current invention.

Following the printing process, the fabric may be further treated with other mechanical or chemical finishes. For example, it may be desirable to add chemicals which enhance the fabric's flammability, soil release, pilling resistance, strength, etc., depending on the end-use of the fabric. Chemical application may be accomplished by immersion coating, padding, spraying, foam coating, or by any other technique whereby one can apply a controlled amount of a liquid suspension to a fabric. Employing one or more of these application techniques may allow the chemical to be applied to the fabric in a uniform manner.

Additionally, because this nonwoven fabric is typically comprised of endless, continuous filaments, the fabric generally does not require further finishing of its edges after it has been cut during its manufacture into a finished product, wherein cutting may be accomplished by various methods known to those skilled in the art such as via knife, scissors, die cutter, slitter, etc. Comparatively, most textile fabrics require that their edges be sewn or somehow sealed before use as a final product by a consumer in order to prevent the fabric from unraveling or fraying during use or after laundering. This requirement typically imparts additional cost and process complexity to the creation of the final product. Thus, because of this unexpected and advantageous feature of the microdenier nonwoven fabric, the fabric may be manufactured at a lower cost and with less complexity than other fabrics, which, ultimately, results in greater consumer appeal and desire.

It is further contemplated to be within the scope of this invention that the textile substrate that is printed with a three-dimensional pattern, preferably using puff pigment and a screen printing machine, may be a knitted or woven fabric. More preferably, the knitted or woven fabric may be comprised of microdenier size fiber (i.e., fiber having less than 1 denier per filament). The knitted or woven fabric may be comprised of single component or multi-component fibers, wherein the multi-component fibers may be splittable along their length by mechanical or chemical action. The knitted or woven fabric may be manufactured from fibers of various fiber types including polyester, such as, for example, polyethylene terephthalate, polytriphenylene terephthalate, and polybutylene terephthalate; polyamide, such as, for example, nylon 6 and nylon 6,6; polyolefins, such as, for example, polypropylene, polyethylene, and the like; polyaramides, such as, for example, Kevlar®; polyurethanes; polylactic acid; and any combination thereof.

The fabric of the current invention may further be incorporated into a composite material, wherein the other layers comprising the composite material are selected from the group consisting of nonwoven, woven, and/or knitted fabric; films; foams; adhesives; and combinations thereof. Additionally, the three-dimensionally printed fabric may be laminated with other fabric layers, films, or foam materials.

The following example illustrates one embodiment of the present invention but is not intended to restrict the scope thereof.

The fabric used in the following example was a nonwoven fabric comprised of spun-bonded continuous multi-component fibers which have been exposed to mechanical or chemical processes to cause the multi-component fibers to split, at least partially, along their length into individual polyester and nylon 6,6 fibers, according to processes described in the two Freudenberg patents earlier incorporated by reference. The polyester fiber comprised about 65% of the fabric, and the nylon 6,6 fiber comprised about 35% of the fabric. The fabric was solution dyed using pigmented chip in the fiber extrusion process prior to fabric formation. The fabric was 100 g/m$^2$ standard (non point-bonded) Evolon®, and it was obtained from Firma Carl Freudenberg of Weinheim, Germany.

All of the test methods used for testing the fabric are standard textile testing methods that are readily available and known to those skilled in the art. They include, for example, Ford Laboratory Test Methods (FLTM), Society of Automotive Engineers (SAE) test methods, International Standards Organization (ISO) test methods, and American Standard and Testing Materials (ASTM) test methods. Some of these test methods offer testing in both the warp and fill direction of the fabric. Since the fabric tested in the example below is a nonwoven fabric which, by definition, has no warp and fill direction, the warp direction of the fabric was estimated to be the direction the fabric entered and exited the machine during manufacturing (i.e., "machine direction"), and the fill direction of the fabric was estimated to be perpendicular to the machine direction. The fabric tested on the bias was tested at a 45-degree angle from its warp, or machine, direction.

EXAMPLE

Approximately a 25-yard piece of solution dyed, standard (non-point bonded) Evolon® fabric was attached to a Stork rotary screen printing machine. A split screen having five different patterns across its width was installed on the machine. A puff pigment paste, Mill Puff AF (available from Pioneer Chemical of Greenville, S.C.), having a viscosity of 30 cp was added to the machine. The puff pigment paste was forced through the holes in the screen at a pressure of 20 bar while the fabric was run through the screen printer at a speed of 20 yards per minute. The fabric was then dried in a relaxed pinless dryer at 300 degrees F. and was then cured on a pin tenter frame at 325 degrees F. for 1 minute. The fabric was then tested for various performance parameters and compared with Original Equipment Manufacturer (OEM) Specifications for automotive headliner fabric. The results are shown in Table 1 below.

TABLE 1

Nonwoven Fabric Screen Printed with Puff Pigment

| Test Method | Test Description | | Puff Print on Solution Dyed Nonwoven | Units/Scale | OEM Specifications |
|---|---|---|---|---|---|
| FLTM BN 107-01 | Wet Crock | Warp | 1.56 | Color Change (▼E) | Max 7.0 |
| FLTM BN 107-01 | | Fill | 1.28 | Color Change (▼E) | Max 7.0 |
| FLTM BN 107-01 | | Bias | 1.35 | Color Change (▼E) | Max 7.0 |
| FLTM BN 107-02 | Dry Crock | Warp | 1.41 | Color Change (▼E) | Max 7.0 |
| FLTM BN 107-02 | | Fill | 1.48 | Color Change (▼E) | Max 7.0 |
| FLTM BN 107-02 | | Bias | 1.45 | Color Change (▼E) | Max 7.0 |
| SAE J948 | Taber Abrasion | GM Method | 4 | Scale 1–5 | Min 3.0 |
| SAE J948 | | Ford Method | 4 | Scale 1–5 | Min 3.0 |
| ISO 3795/SAE J369 | Flammability | Warp | 85.4 | mm/min | Max 100 |
| ISO 3795/SAE J369 | | Fill | 98.1 | mm/min | Max 100 |
| SAE J1756 | Fogging | 1 hr | 99.40 | Fog Number | Min 70 |
| SAE J1756 | | 16 hr | 99.50 | Fog Number | Min 70 |
| SAE J1885 | Fade | 112.8 kJ/m2 | 0.55 | Color Change (▼E) | Max 2.5 |
| SAE J1885 | | 225.6 kJ/m2 | 0.60 | Color Change (▼E) | Max 3.5 |
| ASTM D5034 | Breaking Strength (as received) | Warp | 311 | N | Min 35N |
| | | Fill | 294 | N | Min 35N |
| ISO 105-A02 | Heat Aging | 7 DAYS @ 90° C. | 5 | Scale (1–5) | Min 4.0 |
| FLTM BN 112-08 | Cleanability | | 1.43 | Color Change (▼E) | Max 7.0 |
| FLTM BO 131-01/SAE J 1351 | Odor | | 1 | Scale (1–5) | Max 2.0 |

Several observations can be made regarding the data in Table 1. First, the three-dimensionally printed fabric meets or exceeds all of the requirements shown above for its use as automotive headliner fabric. The data shows that the fabric possesses superior taber abrasion, breaking strength, and cleanability; the fabric advantageously generates very little fogging and odor. Further, it is known to those skilled in the art that many of the tests used for automotive standards are typically more stringent than requirements for other fabric end-uses. Thus, the printed fabric would likely be ideally suited for use as apparel, drapery, upholstery, and cleaning cloths.

The above description and example disclose the inventive nonwoven fabric having a three-dimensional printed surface. The printed surface provides desirable texture, depth, and preferably, color features to the nonwoven fabric that are aesthetically pleasing and performance enhancing. The printed fabric may be achieved by screen printing the fabric with a puff pigment, thereby creating a raised, three-dimensional pattern on its surface. The fabric typically possesses the further advantage of providing increased surface area which generally enhances the puff pigment's adherence to the fabric surface. Additionally, because the fabric is preferably comprised of endless, continuous filaments, the fabric may be manufactured into an end-use product without requiring further finishing of its cut edges to prevent them from fraying or unraveling, thereby reducing cost and manufacturing complexity. Accordingly, the invention has many applicable uses for use as automotive trunk lining and interior fabric such as, for example, headliner fabric, upholstery, door panels, package trays, armrests, headrests, etc. Furthermore, the fabric has many other applicable uses for incorporation into articles of apparel, drapery, cleaning cloths, residential upholstery, commercial upholstery, office panels, and any other article wherein it is desirable to manufacture a fabric having a three-dimensional printed surface.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

We claim:

1. A method for providing a spun-bonded nonwoven fabric comprised of continuous multi-component fibers that are at least partially split along their length into individual filament fibers by mechanical or chemical action, wherein the spun-bonded nonwoven fabric has a three-dimensional printed surface, the method comprising the sequential steps of:

(a) providing a spun-bonded nonwoven fabric comprised of continuous multi-component fibers which have been at least partially split along their length;

(b) screen printing the spun-bonded nonwoven fabric with pigment containing a puffing agent to provide a printed spun-bonded nonwoven fabric;

(c) drying the printed spun-bonded nonwoven fabric;

(d) curing the printed spun-bonded nonwoven fabric; and (e) optionally, subjecting the printed spun-bonded nonwoven fabric to further chemical or mechanical finishing processes.

2. The method of claim 1, wherein the spun-bonded nonwoven fabric is dyed.

3. The method of claim 1, wherein the spun-bonded nonwoven fabric is undyed.

4. The method of claim 1, wherein the spun-bonded nonwoven fabric is comprised of multi-component fibers, end wherein the multi-component fibers are characterized by having a fiber size of less than 5 denier.

5. The method of claim 1, wherein the multi-component fibers are at least partially split along their length into individual filament fibers by mechanical or chemical action, and wherein the individual filament fibers are characterized by having a fiber size of less than 1 denier.

6. The method of claim 1, wherein the spun-bonded nonwoven fabric is comprised of fibers selected from the group consisting of polyester, polyamide, polyolefin, polyaramide, polyurethane, polylactic acid, and combinations thereof.

7. The method of claim 6, wherein the fiber is polyester, and wherein the polyester is selected from the group consisting of polyethylene terephthalate, polytriphenylene terephthalate, polybutylene terephthalate, and combinations thereof.

8. The method of claim 6, wherein the fiber is polyolefin, and wherein the polyolefin is selected from the group consisting of polypropylene, polyethylene, and combinations thereof.

9. The method of claim 6, wherein the fiber is polyamide, and wherein the polyamide is selected from the group consisting of nylon 6, nylon 6,6, and combinations thereof.

10. The method of claim 9, wherein the spun-bonded nonwoven fabric is comprised of polyester and nylon 6,6.

11. The method of claim 10, wherein the spun-bonded nonwoven fabric is comprised of polyester and nylon 6,6, wherein the polyester comprises approximately 65% by weight of the spun-bonded nonwoven fabric, and wherein the nylon 6,6 comprises approximately 35% by weight of the spun-bonded nonwoven fabric.

12. The method of claim 1, wherein the puffing agent produces a gas during the drying step which raises the pigment containing a puffing agent and creates a three-dimensional printed surface on the spun-bonded nonwoven fabric.

13. The method of claim 1, wherein the pigment containing a puffing agent also includes a binding agent.

14. The method of claim 13, wherein the binding agent is activated during the curing step which enhances the adhesion between the pigment containing a puffing agent and the spun-bonded nonwoven fabric.

15. The method of claim 1, wherein the three-dimensional printed surface imparts between about 2 and about 60 percent print coverage on the surface of the printed spun-bonded nonwoven fabric.

16. The method of claim 1, wherein the three-dimensional printed surface imparts between about 5 and about 30 percent print coverage on the surface of the printed spun-bonded nonwoven fabric.

17. The method of claim 1, wherein the three-dimensional printed surface imparts less than about 2 percent print coverage on the surface of the printed spun-bonded nonwoven fabric.

18. The method or claim 1, wherein the three-dimensional printed surface imparts more than 60 percent print coverage on the surface of the printed spun-bonded nonwoven fabric.

* * * * *